US005314318A

United States Patent [19]

Hata et al.

[11] Patent Number: 5,314,318

[45] Date of Patent: May 24, 1994

[54] HORIZONTAL MULTI-CYLINDER ROTARY COMPRESSOR

[75] Inventors: Hiroaki Hata; Kazuhisa Ichimoto; Kazunori Morita; Junichi Fukayama, all of Tochigi, Japan

[73] Assignee: Hitachi, Ltd., Tokyo, Japan

[21] Appl. No.: 16,884

[22] Filed: Feb. 12, 1993

[30] Foreign Application Priority Data

Feb. 18, 1992 [JP] Japan ..... 4-029871

[51] Int. Cl.[5] ..... F01C 1/02

[52] U.S. Cl. ..... 418/60; 418/63; 418/88; 418/94

[58] Field of Search ..... 418/60, 63, 88, 94, 418/96; 417/902

[56] References Cited

U.S. PATENT DOCUMENTS 4,543,047 9/1985 Hasegawa ..... 418/63
4,561,829 12/1985 Iwata et al. ..... 418/63
4,626,180 12/1986 Tagawa et al. ..... 418/63

FOREIGN PATENT DOCUMENTS 188092 6/1989 Japan .
0300083 12/1989 Japan ..... 418/60

*Primary Examiner*—Richard A. Bertsch
*Assistant Examiner*—Charles G. Freay
*Attorney, Agent, or Firm*—Fay Sharpe, Beall, Fagan, Minnich & McKee

[57] ABSTRACT

A plurality of vane chambers on the back side of vanes are caused to function as pump chambers using the reciprocating movement of the vanes to pressure-feed a lubricating oil to a compressor mechanism unit. A taper hole at one of the vane chambers for drawing the lubricating oil, a hole on another chamber for mitigating back pressure and a taper hole between the chambers are provided to improve the pressure feeding capability. In addition, the lubricating oil having been supplied to the compressor mechanism unit is supplied to the slide surfaces of crank portions from an oil hole of each crank portion through an oil passage at the center of the rotating shaft and is further distributed optimally to slide bearing portions by oil guide grooves. A horizontal multiple cylinder rotary compressor is thereby provided, which employs an oil supplying structure capable of supplying lubricating oil stably and at an optimal distribution, which provides high reliability and high efficiency and by which vibration is reduced and space is saved.

14 Claims, 4 Drawing Sheets

HORIZONTAL MULTI-CYLINDER ROTARY COMPRESSOR

BACKGROUND OF THE INVENTION

1. Field of the Invention

The present invention relates to horizontal multi-cylinder rotary compressors and, more particularly, it relates to the oil supplying structure of a rotary compressor having multiple cylinders, suitable in refrigerating and air conditioning machines such as a refrigerator, an air conditioner or the like by which power and space are saved less vibration and lower noise are caused, and there is highly reliable.

2. Description of the Related Art

In recent years, compressors to be mounted on refrigerating and air conditioning machines and equipments are required not only to provide fundamental performance with respect to less vibration, lower noise and higher efficiency but also to take up less space and have high reliability. For this reason, a high efficiency rotary compressor is horizontally placed to improve its space-saving characteristic. That is, a horizontal rotary compressor of a single cylinder has been among compressors to be mounted on a conventional refrigerator. Recently, however, development is in progress of a rotary compressor having two cylinders which is efficient in reducing vibrations of the compressor, to respond to the demand in the market for further reduction of vibrations and noise.

A two-cylinder compressor is constructed such that the rotating shaft thereof has two eccentric portions that are different in their phase from each other by 180°, so that two rollers fitted on these eccentric portions are eccentrically rotated in the cylinders. Changes in gas compressing torque generated at the two pump units (compressor unit) are thereby leveled off to reduce vibrations of the compressor. For instance, a horizontal rotary compressor having two cylinders such as disclosed in Japanese Utility Model Unexamined Publication No.1-88092 is known as an example of a two-cylinder horizontal rotary compressor.

It is necessary in a horizontal rotary compressor to draw up the lubricating oil reserved at the bottom portion of a sealed container to supply it to the slide portions of the compressor mechanism unit.

FIG. 5 is a cross-sectional view of the main portion of a conventional horizontal single cylinder rotary compressor.

For the oil supplying structure in a single cylinder horizontal rotary compressor, there is an example as shown in FIG. 5 where fluidic diodes 20*a*, 21 are provided at an inlet side and an outlet side of a vane chamber 14 behind a vane 13 to suck lubricating oil and to thereby supply the lubricating oil to the slide portion of the compressor through an oil supply pipe 22. In the case of a multi-cylinder rotary compressor, however, a problem occurs that the lubricating oil cannot be stably supplied to the compressor mechanism unit by using the conventional oil supplying means shown in FIG. 5, because a plurality of vane chambers are provided.

Further, a description will now be given by way of FIG. 6 with respect to the oil supplying structure of a two-cylinder horizontal rotary compressor as disclosed in Japanese Utility Model Unexamined Publication No.1-88092.

FIG. 6 is a cross sectional view of the main portion of a conventional horizontal two-cylinder rotary compressor.

Referring to FIG. 6, numerals are used to respectively denote: a main bearing 6; a first cylinder 7; a diaphragm 8; a second cylinder 9; a sub-bearing 10; and vane chambers 14, 15.

An oil returning hole 18*a* for communication between the vane chamber 14 and the motor chamber 16 is provided on a holding plate 19 for separating the interior of the sealed container into a motor chamber 16 and a machine chamber 17, and a backward flow prevention mechanism 24 for preventing a backward flow of the lubricating oil from the machine chamber to the motor chamber is provided on the vane chamber 14. An oil supplying mechanism is thereby achieved such that the lubricating oil sucked to the vane chamber 14 from the motor chamber 16 by the reciprocating movement of the vane 13*a* is caused to flow to the machine chamber 17 while preventing backward flow of the lubricating oil from the machine chamber 17 to the motor chamber 16.

However, due to such facts as that a valve or the like is additionally necessary behind the vane chamber 14 as the backward flow prevention mechanism 24 and that a separation within the sealed container by the holding plate 19 is necessary, the structure of the compressor becomes complicated, resulting in a problem that its reduction in size is difficult so that it is deprived of space-saving characteristic. Further, in this conventional example, no description has been made with respect to detailed structure of the distributing means by which the lubricating oil supplied to the compressor mechanism unit is distributed to each slide portion.

SUMMARY OF THE INVENTION

The present invention has been made to eliminate the problems of the above described conventional art. Accordingly, it is a first object of the present invention to provide a horizontal multi-cylinder rotary compressor having a small sized oil supplying structure capable of stably supplying oil to the compressor mechanism unit of the horizontal rotary compressor which has a plurality of cylinders.

Further, it is a second object of the present invention to provide a horizontal multi-cylinder rotary compressor having means by which the lubricating oil supplied to the compressor mechanism unit is suitably distributed to each slide portion.

Furthermore, it is a third object of the present invention to provide to the market a horizontal multi-cylinder rotary compressor and refrigerating and air conditioning apparatus by which power and space are saved and vibrations and noise are reduced and which is highly reliable.

To achieve the above first object, a horizontal multi-cylinder rotary compressor is provided in accordance with the present invention, which has a compressor mechanism unit for compressing refrigerant and an electric motor unit for driving the compressor mechanism unit within a sealed container where lubricating oil is reserved at the bottom portion thereof, in which the above compressor mechanism unit comprises a plurality of cylinders where the rotating shaft of the compressor mechanism unit is supported generally horizontally by a bearing portion including a main bearing and a sub-bearing, and which includes: a first vane chamber formed in a sealed manner behind a first vane that reciprocates by following a roller which is eccentrically rotated within a first cylinder as the above rotating shaft rotates; a second vane chamber formed in a sealed manner behind a second vane which similarly reciprocates within a second cylinder; where the first vane chamber has a first communication passage communicating with a lubricating oil reservoir at the bottom portion of the above sealed container; and the second vane chamber has an oil supplying passage for supplying the lubricating oil to the bearing portion of the compressor mechanism unit, a hole for the communication with the first vane chamber, and a second communication passage communicating with the lubricating oil reservoir at the bottom portion of the sealed container.

In addition, the sectional shape of the second communication passage provided on the second vane chamber for communication with the lubricating oil reservoir at the bottom portion of the sealed container is substantially taper-like or stepped, which is wider toward the lubricating oil reservoir and is narrower toward the second vane chamber.

Furthermore, the sectional shape of the hole provided on the second vane chamber for communication with the first vane chamber is substantially a taper-like or stepped, which is narrower toward the second vane chamber and is wider toward the first vane chamber.

Further, to achieve the second object of the present invention, a rotary compressor according to the present invention is constructed such that: a first oil supply hole communicating with the oil supplying passage is provided at the interior of the rotating shaft; second oil supply holes for supplying lubricating oil respectively to the roller's interior space within the and the roller's interior space within the second cylinder are provided on respective crank portions of the rotating shaft; loop-like reservoirs are provided on the two sides of the crank portions; and an oil guide groove for supplying the lubricating oil to the inner surface of the slide bearing based on the rotation of the rotating shaft is provided on the outer diameter surface of the rotating shaft which faces the main bearing and sub-bearing, with an angle to the center line of the rotating shaft in an inverted V-like shape in relation to the rotating direction thereof.

DESCRIPTION OF THE PREFERRED EMBODIMENTS

Figure 1:
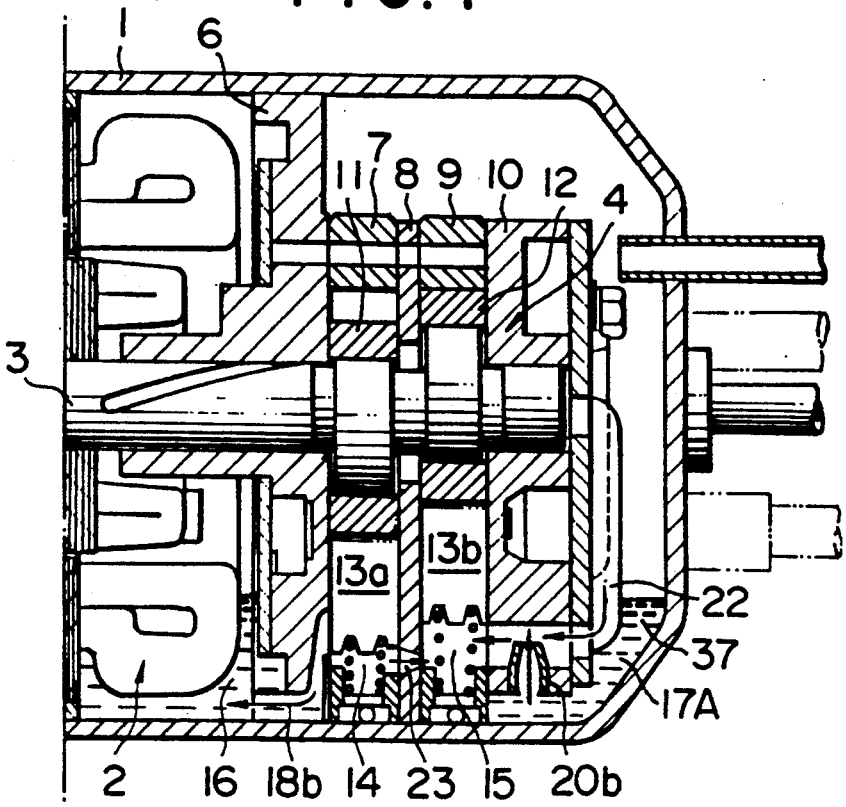
FIG. 1 is a longitudinal sectional view showing the oil supplying structure of a two cylinder rotary compressor according to an embodiment of the present invention.

An embodiment of the present invention will now be described with reference to FIGS. 1 to 4. FIG. 4 shows a longitudinal section of a horizontal two-cylinder rotary compressor according to an embodiment of the present invention.

In the horizontal multi-cylinder rotary compressor shown in FIG. 4, a sealed container 1 contains an electric motor unit 2 and a compressor mechanism unit 4 formed of a pair of pump portions directly connected to the electric motor 2 through a rotating shaft 3. The electric motor unit 2 includes a stator 35 fixed on the sealed container 1 and a rotor 36 on which the rotating shaft 3 is fitted. The compressor mechanism unit 4 has two rotary compressor devices (pump portions), where the first pump portion is constituted by a main bearing 6 for supporting the rotating shaft 3, a first cylinder 7 and a diaphragm 8. The second pump portion is constituted by the above diaphragm 8, a second cylinder 9, and a subbearing 10 for supporting the rotating shaft 3. Here, the main bearing 6 is fixed on the sealed container 1.

The rotating shaft 3 has two crank portions 26, 27 which are different in phase from each other, so that rollers 11, 12 associated with two rolling pistons fitted on these crank portions 26, 27 are eccentrically rotated respectively within the first cylinder 7 and the second cylinder 9 as the rotating shaft 3 is rotated. Vanes **13*a*, 13*b* are reciprocated within the respective cylinders following the rotation of these rollers 11, 12** to alternately compress a refrigerant gas.

A description will now be given with respect to the oil supplying structure of the present invention.

Figure 2:
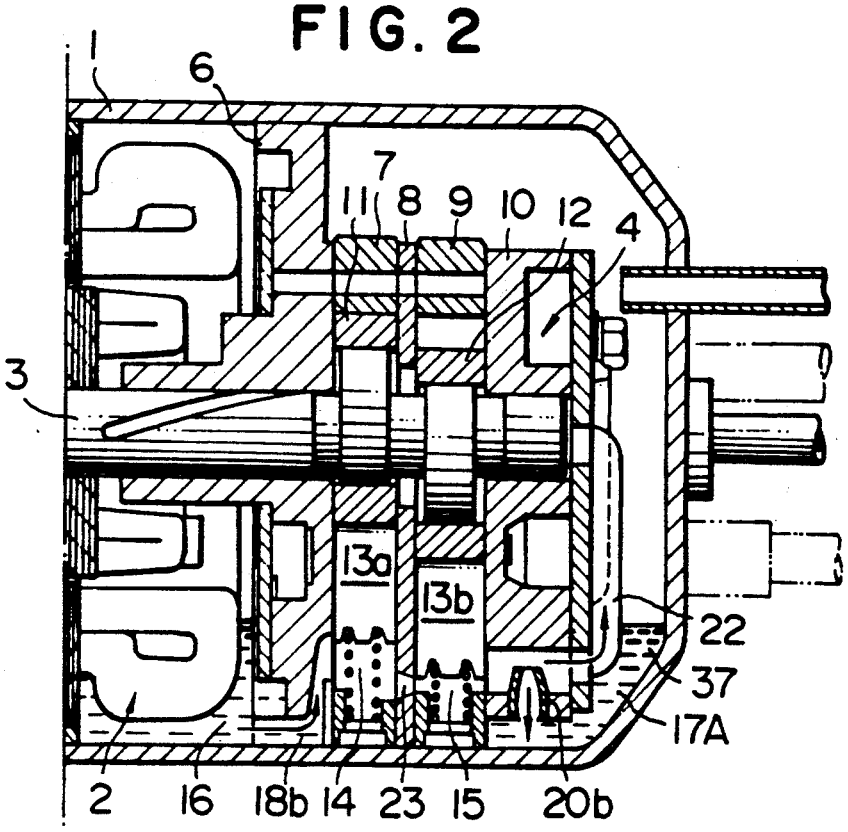
FIG. 2 is a longitudinal sectional view showing the oil supplying structure of the two cylinder rotary compressor according to the embodiment of the present invention in a different position.

FIG. 1 shows the state where the roller 11 of the first cylinder 7 is positioned at the bottom dead center while the roller 12 of the second cylinder 9 is positioned at the top dead center, the arrows in the figure indicating the flow of the lubricating oil. Further, FIG. 2 shows the state where the roller 11 of the first cylinder 7 is positioned at the top dead center while the roller 12 of the second cylinder 9 is positioned at the bottom dead center.

As the vane **13*b* of the second cylinder 9 rises, the lubricating oil 37 reserved in the lubricating oil reservoir portion 17A at the bottom of the sealed container 1 is sucked to a second vane chamber 15 through a second communication passage 20*b*. Further, in a first vane chamber 14, the vane 13*a* is lowered so that the lubricating oil is forced out from the hole 23 to the second vane chamber 15 and at the same time is caused to flow out from a first communication passage 18*b*. Furthermore, when the rotating shaft 3 is rotated to lower the vane 13*b* of the second cylinder 9, the lubricating oil sucked into the second vane chamber 15 is forced out and is supplied to the compressor mechanism unit through the oil supplying pipe 22. Here, since the second communication passage 20*b* is formed into a taper-like or stepped shape which is narrower toward the second vane chamber 15, a backward flow to the lubricating oil reservoir portion 17A** is difficult to occur due to the effect of the fluidic diode.

On the other hand, since the vane **13*a* is raised in the first vane chamber 14 to draw the lubricating oil to the first vane chamber 14 from the first communication passage 18*b*, the vane 13*a* is always exposed to fresh lubricating oil so that seizure or the like thereof may be prevented. Further, since the hole 23 is formed into substantially a taper-like or stepped shape where it is narrower toward the second vane chamber 15 while it is wider toward the first vane chamber 14, the lubricating oil is difficult to flow backward to the first vane chamber 14 from the second vane chamber 15 due to the effect of the fluidic diode thereof. Furthermore, since the first communication passage 18*b* is provided, it is possible to mitigate the pressure in the first vane chamber 14 and to make smaller the pressure change (back pressure) of the first vane chamber 14. Thus the loss of motive force due to the reciprocating movement of the vane 13*a*** may be reduced.

The reason why the supplied lubricating oil is optimally distributed to the compressor mechanism unit will now be described with reference to FIG. 3.

Figure 3:
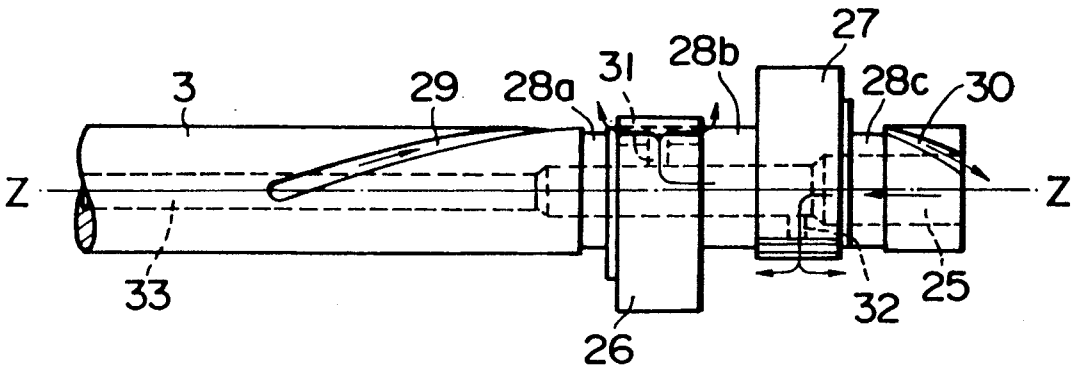
FIG. 3 is a explanatory view showing the oil supplying structure of the rotating shaft of the two cylinder rotary compressor shown in FIG. 1.
Figure 4:
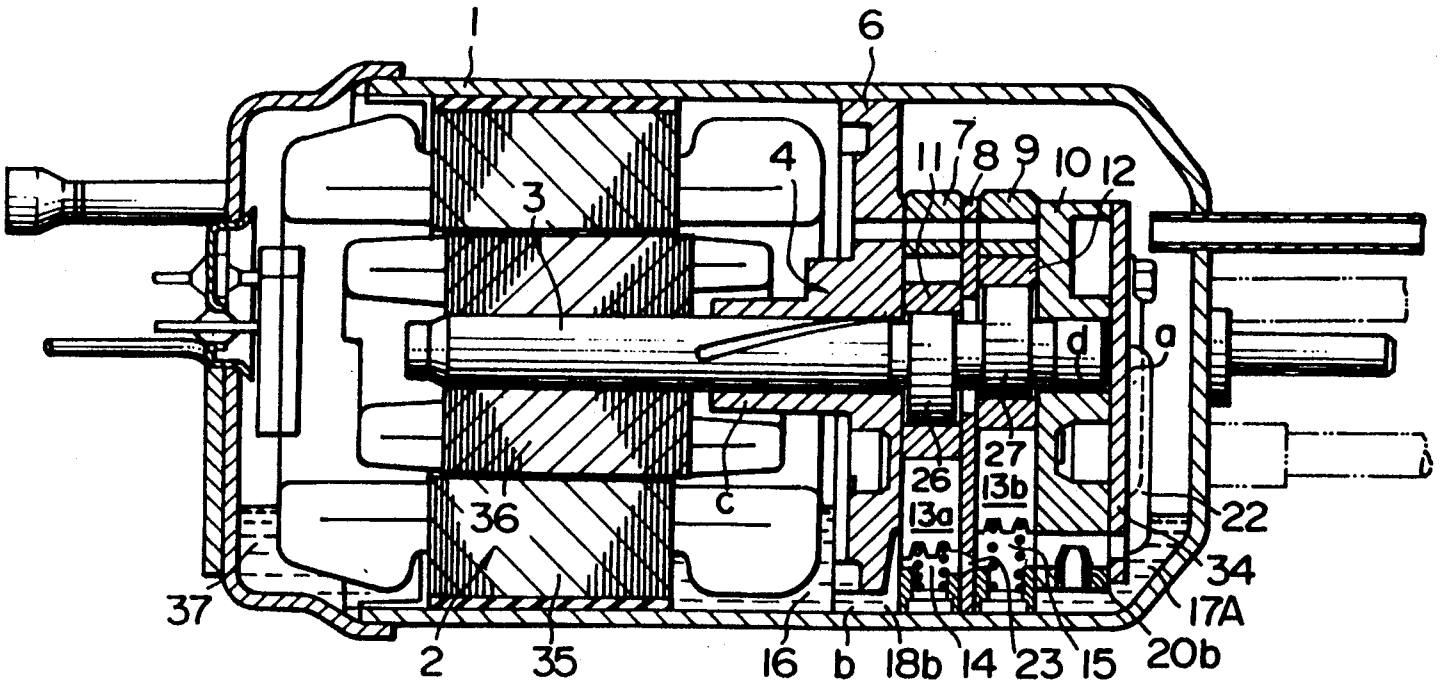
FIG. 4 is a longitudinal sectional view showing the horizontal two-cylinder rotary compressor according to the embodiment of the present invention.
Figure 5:
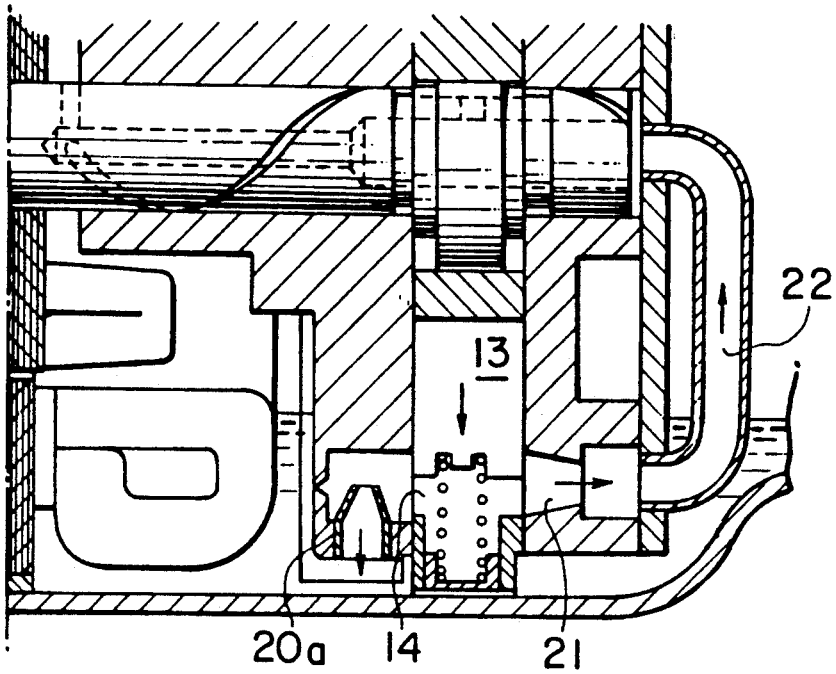
FIG. 5 PRIOR ART
FIG. 5 is a longitudinal sectional view of the main portion of a conventional horizontal single-cylinder rotary compressor.
Figure 6:
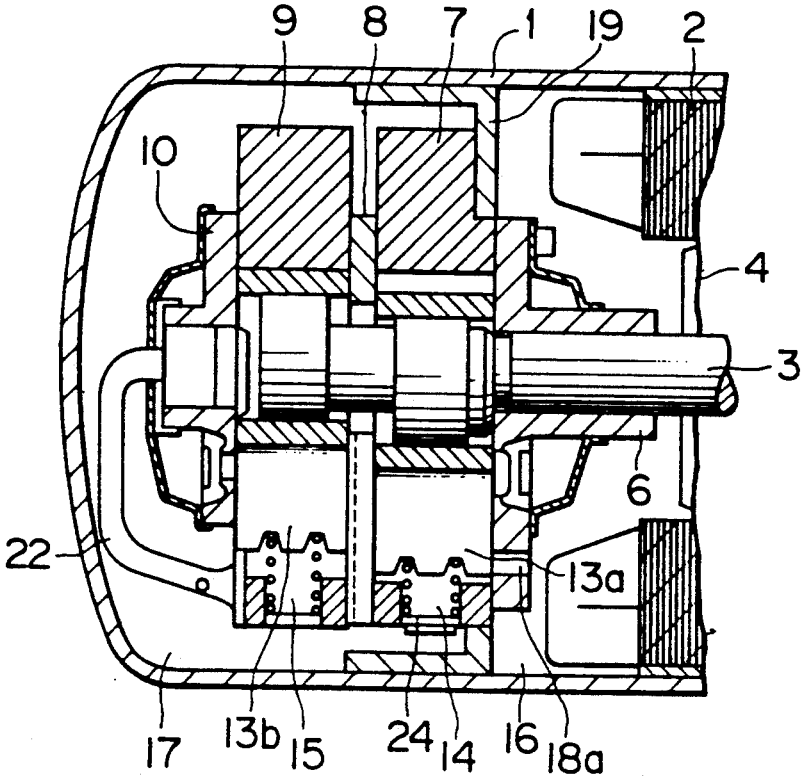
FIG. 6 PRIOR ART
FIG. 6 is a longitudinal sectional view of the main portion of a conventional horizontal two-cylinder rotary compressor.

As indicated by the arrows in FIG. 3, the lubricating oil flowing out through the oil supplying pipe 22 is caused to flow through end plate 34 (FIG. 4) into an oil supplying through hole 25, with reduced diameter portion 33, at the interior of the rotating shaft 3. The introduced lubricating oil is caused to flow along the internal wall of the oil supplying through hole 25 as indicated by the arrows in the figure due to the centrifugal force generated by the rotation thereof, and it is caused to flow out from an oil supplying hole 32 of the crank portion 27 and an oil supplying hole 31 of the crank portion 26 into the roller's internal space within the second cylinder and the roller's internal space within the first cylinder, respectively, so as to perform lubrication of the rollers 11, 12 and the slide portions of the cranks.

Further, the lubricating oil supplied to circular oil reservoir portions **28*a*, 28*b*, 28*c* provided on the both sides of the crank portions 26, 27 is supplied to the inner slide bearing surface of the main bearing 6 and the sub-bearing 10 to perform lubrication of the slide portions, by the viscous pumping effect resulting from the rotation of the oil guide grooves 29, 30** which are provided on the rotating shaft's outer diameter surface facing the bearing in substantially the manner of an inverted "V" with respect to the rotating direction thereof, with keeping an angle with respect to the center line Z–Z of the rotating shaft.

In this manner, according to the oil supplying structure of the present invention, the lubricating oil supplied to the compressor mechanism unit may be optimally distributed to each slide portion.

As has been described, according to the oil supplying structure of the present invention, the lubricating oil may be stably supplied without using a diaphragm or a complicated mechanism for preventing a backward flow. Thus a reduction in size thereof is possible and the loss of motive force due to supplying operation of oil may be minimized.

To confirm the effect of the invention, the present inventors measured the temperature at the slide bearing portions of the horizontal multiple cylinder rotary compressor. The result is shown in Table 1.

The points as shown in FIG. 4 at which the temperature is measured are: the outlet portion of the oil supplying pipe 22 (point "a" in the figure); the lower portion of the slide bearing of the main bearing 6 (point "b" in the figure); the upper portion of the slide bearing of the main bearing 7 (point "c" in the figure); and the slide bearing portion of the sub-bearing 10 (point "d" in the figure).

TABLE 1

| Measured point | Measured portion | Temperature (°C.) |
|---|---|---|
| a | Oil supply pipe outlet portion | 94 |
| b | Lower portion of main bearing | 97 |
| c | Upper portion of main bearing | 97 |
| d | Sub-bearing portion | 96 |
| — | Stator coil temperature | 94 |

Compressor operated at 60 Hz

The values in Table 1 are the temperatures of the respective slide portions when the compressor is steadily operated at its rated condition, these values being compared with the stator coil temperature at that time. It can be seen that the lubricating oil is optimally distributed to each slide portion as the temperature difference in the respective slide portions is within 3° C. for all of the points "b", "c", "d". Further, in comparison to the stator coil temperature, the temperature rise for all the temperatures of the outlet portion of the oil supply pipe 22 (point "a" in the figure) and of points "b", "c", "d" of the slide portions is within 5° C. Thus it can be seen that the oil supplying structure of the present invention is capable of supplying a necessary and sufficient amount of lubricating oil to the slide portions and is highly reliable.

Next, in order to confirm the high efficiency, the present inventors used a calorimeter for testing a compressor to measure the coefficient of performance (=refrigerating capacity/compressor input) of the compressor, i.e. COP, and the vibration acceleration in the rotating direction of the compressor. The result was compared with that of a conventional horizontal single-cylinder rotary compressor which had an identical refrigerating capacity.

TABLE 2

| System | COP (%) | Vibration acceleration (%) |
|---|---|---|
| Single cylinder | 100/100 | 100/100 |
| Two cylinder | 107/107 | 25/25 |

Values of 100 are set for the case of the single cylinder. Operated at 50/60 Hz

The values in Table 2 are obtained by comparing the results of the test where the compressors are steadily operated at their rated conditions of 50/60 Hz.

As is apparent from the table, its vibration acceleration is ¼ comparing to the horizontal rotary compressor with a single cylinder and its COP is increased by 7% comparing to that of the conventional art. The reason for the above result is that, since an alternating compression is achieved by the two cylinder rotary compressor, gas compressing torque and load on bearings are leveled off to reduce vibrations. Further, in addition to the leveling off of load on the bearings as described, the sliding loss between shaft and bearing is reduced and loss of the motive force by supplying of oil is reduced due to the fact that the lubricating oil is stably supplied. Its COP is thus improved. Further, since it causes less vibration, the vibrations propagating through structure such as attaching portion of the compressor, connected piping or the like become smaller to thereby reduce the noise resulting from such vibrations.

As has been described in detail, according to the present invention, a horizontal multi-cylinder rotary compressor may be provided, which has a smaller oil supplying structure capable of stably supplying oil to the compressor mechanism unit of the horizontal rotary compressor having a plurality of cylinders.

Further, according to the present invention, a horizontal multi-cylinder rotary compressor may be provided, which has means for optimally distributing to each slide portion the lubricating oil having been supplied to the compressor mechanism unit thereof.

Furthermore, according to the present invention, it is possible to provide to the market a horizontal multi-cylinder rotary compressor and refrigerating and air conditioning apparatus by which power and space are saved and vibrations and noise are reduced and which is highly reliable.

What is claimed is:

1. A horizontal multi-cylinder rotary compressor, comprising:

a compressor mechanism unit for compressing refrigerant and being within a sealed container;

an electric motor unit for driving the compressor mechanism unit and being within the sealed container;

a lubricating oil reservoir at a bottom portion of the sealed container for each of said compressor mechanism unit and said electric motor unit, said reservoirs being separate from each other;

said compressor mechanism unit having a plurality of cylinders and a rotating shaft of the compressor mechanism unit supported generally horizontally by a bearing portion including a main bearing and sub-bearing;

a first vane chamber formed in a sealed manner with respect to the reservoirs behind a first vane that reciprocates by following a roller which is eccentrically rotated within a first cylinder as said rotating shaft rotates;

a second vane chamber formed in a sealed manner with respect to the reservoirs behind a second vane which similarly reciprocates within a second cylinder;

a first communication passage provided in said first vane chamber and communicating lubricating oil directly with the lubricating oil reservoir of the electric motor unit at the bottom portion of the said sealed container;

said second vane chamber being provided with an oil supply passage for supplying the lubricating oil to said bearing portion of the compressor mechanism unit, a hole for communication lubricating oil directly with the first vane chamber, and a second communication passage communication lubricating oil with the lubricating oil reservoir of the compressor mechanism unit at the bottom portion of the sealed container; and said first vane chamber being sealed except for said hole and said first communication passage.

2. A horizontal multi-cylinder rotary compressor according to claim 1, wherein a first oil supply hole communicating with said oil supply passage is provided at the interior of said rotating shaft; second oil supply holes are provided on respective crank portions of said rotating shaft in such a manner as to extend in respective radial directions of said crank portions; loop-like reservoirs are provided on both sides of said crank portions; and an oil guide groove for supplying the lubricating oil to the inner surface of the slide bearing based on the rotation of the rotating shaft is provided on the outer diameter surface of the rotating shaft which faces said main bearing and said sub-bearing, with an angle with respect to the center line of said rotating shaft in an inverted V-like manner in relation to the rotating direction thereof.

3. A horizontal multi-cylinder rotary compressor according to claim 1, wherein said second communication passage has a substantially taper like or stepped sectional shape which is wider toward the lubricating oil reservoir and is narrower toward the second vane chamber to constitute a fluidic diode.

4. A horizontal multi-cylinder rotary compressor according to claim 1, wherein said hole provided on the second vane chamber for communication with the first vane chamber has a substantially taper-like or stepped sectional shape which is narrower toward the second vane chamber and is wider toward the first vane chamber to constitute a fluidic diode.

5. A refrigerating or air conditioning apparatus having thereon a horizontal multi-cylinder rotary compressor according to claim 1.

6. A horizontal multi-cylinder rotary compressor according to claim 3, wherein said hole provided on the second vane chamber for communication with the first vane chamber has a substantially taper-like or stepped sectional shape which is narrower toward the second vane chamber and is wider toward the first vane chamber to constitute a fluidic diode, so that lubricating oil is freely sucked into said second vane chamber from both said reservoirs through said first and second passages and said hole, and is restricted in backflow through said hole and said second communication passages.

7. A horizontal multi-cylinder rotary compressor according to claim 6, wherein a first oil supply hole communicating with said oil supply passage is provided at the interior of said rotating shaft; second oil supply holes are provided on respective crank portions of said rotating shaft in such a manner as to extend in respective radial directions of said crank portions; loop-like reservoirs are provided on both sides of said crank portions; and an oil guide groove for supplying the lubricating oil to the inner surface of the slide bearing based on the rotation of the rotating shaft is provided on the outer diameter surface of the rotating shaft which faces said main bearing and said sub-bearing, with an angle with respect to the center line of said rotating shaft in an inverted V-like manner in relation to the rotating direction thereof.

8. A refrigerating or air conditioning apparatus having thereon a horizontal multi-cylinder rotary compressor according to claim 7.

9. A horizontal multi-cylinder rotary compressor according to claim 6, wherein said hole and said communication passages extend axially relative to the rotating shaft into said first and second vane chambers.

10. A horizontal multi-cylinder rotary compressor according to claim 1, wherein said hole and said communication passages extend axially relative to the rotating shaft into said first and second vane chambers.

11. A horizontal multi-cylinder rotary compressor according to claim 3, wherein said hole and said communication passages extend axially relative to the rotating shaft into said first and second vane chambers.

12. A horizontal multi-cylinder rotary compressor according to claim 4, wherein said hole and said communication passages extend axially relative to the rotating shaft into said first and second vane chambers.

13. A horizontal multi-cylinder rotary compressor according to claim 1, wherein said hole provided on the second vane chamber for communication with the first vane chamber has a substantially taper-like or stepped sectional shape which is narrower toward the second vane chamber and is wider toward the first vane chamber to constitute a fluidic diode, so that lubricating oil is freely sucked into said second vane chamber from both said reservoirs through said first and second communication passages and said hole, and is restricted in backflow through said hole and said second communication passages.

14. A horizontal multi-cylinder rotary compressor according to claim 13, wherein said hole and said communication passages extend axially relative to the rotating shaft into said first and second vane chambers.

* * * * *